US005625278A

United States Patent [19]

Thiel et al.

[11] Patent Number: 5,625,278

[45] Date of Patent: Apr. 29, 1997

[54] ULTRA-LOW DROP-OUT MONOLITHIC VOLTAGE REGULATOR

[75] Inventors: Frank L. Thiel, Richardson; Todd M. Neale, Carrollton; Baoson Nguyen, Plano; Fernando D. Carvajal, McKinney, all of Tex.

[73] Assignee: Texas Instruments Incorporated, Dallas, Tex.

[21] Appl. No.: 623,595

[22] Filed: Mar. 28, 1996

Related U.S. Application Data

[63] Continuation of Ser. No. 502,405, Jul. 14, 1995, abandoned, which is a continuation of Ser. No. 339,310, Nov. 14, 1994, abandoned, which is a continuation of Ser. No. 70,576, Jun. 2, 1993, abandoned.

[51] Int. Cl.[6] ..... G05F 1/40

[52] U.S. Cl. ..... 323/280; 323/274; 323/281

[58] Field of Search ..... 323/265, 273, 323/274, 280, 281, 313, 349

[56] References Cited

U.S. PATENT DOCUMENTS 4,803,612 2/1989 Skovmand ..... 323/284

*Primary Examiner*—Peter S. Wong
*Assistant Examiner*—Shawn Riley
*Attorney, Agent, or Firm*—Alan K. Stewart; Richard L. Donaldson; William E. Hiller

[57] ABSTRACT

The voltage regulator circuit contains a MOS transistor 12 connected between a voltage supply line 22 and an output line 30. The MOS transistor 12 provides a stable voltage on the output line 30 independent of voltage transients on the voltage supply line 22 and independent of current transients on the output line 30. An amplifier 14 coupled to the MOS transistor 12 controls the response of the MOS transistor 12. Feedback circuitry connected between the output line 30 and the amplifier 14 provides feedback to the amplifier 14. A voltage source 16 provides the reference for amplifier 14.

16 Claims, 1 Drawing Sheet

ULTRA-LOW DROP-OUT MONOLITHIC VOLTAGE REGULATOR

This application is a continuation of application Ser. No. 08/502,405 filed on Jul. 14, 1995, now abandoned, which is a continuation of Ser. No. 08/339,310, filed on Nov. 14, 1994, now abandoned, which is a continuation of Ser. No. 08/070,576, filed Jun. 2, 1993, now abandoned.

FIELD OF THE INVENTION

This invention generally relates to electronic systems and in particular it relates to voltage regulators.

BACKGROUND OF THE INVENTION

The function of a voltage regulator is to take a varying input voltage supply and generate a stable output voltage. The efficiency of modern power supply systems, especially battery operated ones, is directly related to the useable operating voltage and current over head required by the system's voltage regulator. The useable operating voltage is called the "drop-out" voltage, which is the difference between the input and output voltages of the regulator while the regulator still maintains regulation. The smaller this difference, the more efficient the system. Additionally, batteries can supply only a finite amount of charge, so the more quiescent current the regulator uses (which is wasted current as far as the system is concerned), the less life the battery will have and therefore the system will be less efficient.

SUMMARY OF THE INVENTION

It has been discovered that the use of a bipolar transistor in a voltage regulator has been a problem. The power consumption of a bipolar transistor is high because of the base current required to operate the transistor. Also, the voltage drop across a bipolar transistor is high relative to a MOS transistor.

Generally, and in one form of the invention, the voltage regulator circuit contains a MOS transistor connected between a voltage supply line and an output line. The MOS transistor provides a stable voltage on the output line independent of voltage transients on the voltage supply line. An amplifier coupled to the MOS transistor controls the response of the MOS transistor. Feedback circuitry connected between the output line and the amplifier provides feedback to the amplifier.

This invention provides several advantages. One advantage of this invention is that no significant DC control current is needed to control the regulation of the PMOS output which is unlike the typical topology of using a PNP output stage. Another advantage of this invention is the linear response of the PMOS pass device in drop-out, unlike a bipolar PNP which becomes saturated in drop-out and therefore does not have a linear response. Another advantage of this invention is that there is no dramatic rise in current over various regions of operation, whereas a bipolar device has a significant increase in base drive when it becomes saturated. This low current maintains supply efficiency even in drop-out. Another advantage is that much lower drop-out voltages can be obtained from a PMOS device because there is no inherent voltage offset as in a bipolar device.

DETAILED DESCRIPTION OF PREFERRED EMBODIMENTS

Figure 1:
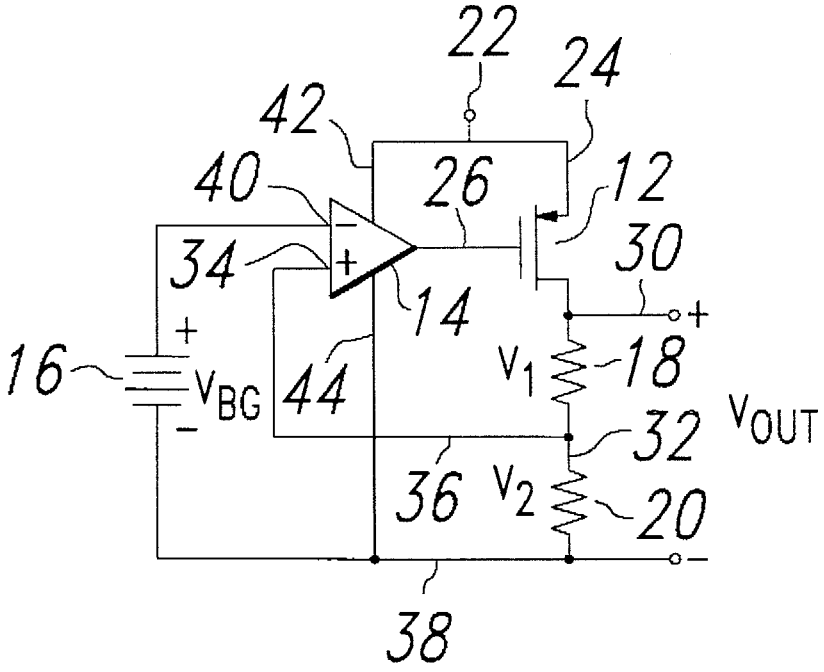
FIG. 1 is a schematic circuit diagram of an ultra-low drop-out monolithic voltage regulator according to the invention. All voltages are in reference to line 38 unless explicitly stated otherwise.

Referring to FIG. 1, a circuit diagram of a preferred embodiment of an ultra-low drop-out monolithic voltage regulator according to the present invention is illustrated. This preferred embodiment is a monolithic voltage regulator which achieves drop-out voltages and quiescent currents that are a fraction of typical voltage regulators, significantly improving system efficiency. The circuit includes PMOS pass device 12 (MOS transistor), error amplifier 14 (operational amplifier), silicon band gap voltage reference 16 (reference voltage source), first resistor 18, and second resistor 20. The first resistor 18 and the second resistor 20 make up the feedback circuitry in the preferred embodiment.

The input voltage (the voltage to be regulated) comes into the circuit shown in FIG. 1 on line 22. The input voltage is coupled to the source of the transistor 12 on line 24. The gate of transistor 12 is coupled to the output of the error amp 14 on line 26. The drain of transistor 12 is coupled to the first end of the first resistor 18 on line 28. The output line 30 of the circuit is also coupled to the drain of the transistor 12. The second end of the first resistor 18 is coupled to the first end of the second resistor 20 through line 32. The first end of the second resistor 20 is also coupled to the plus terminal 34 of the error amp 14 through line 36. The second end of the second resistor 20 is coupled to line 38. The negative terminal 40 of the error amp 14 is coupled to a reference voltage source 16. In the preferred embodiment, the reference voltage source 16 is a silicon bandgap voltage reference which supplies a voltage on the order of 1.21 volts. The band gap voltage source 16 generates a voltage reference that is fixed over the input supply and over temperature and is typically about 1.21 volts which is relative to the band gap voltage of silicon. The input voltage on line 22 also provides the supply voltage for the error amp 14 on line 42. Line 44 connects the error amp 14 to line 38.

The operation of the device is explained with reference to the preferred embodiment shown in FIG. 1. The output voltage on line 30 is regulated by the transistor 12. The error amp 14, which is an operational amplifier, controls the transistor 12 according to the feedback on line 36 which contains the voltage between the first resistor 18 and the second resistor 20. When the input voltage on line 22 changes or the current being drawn from line 30 by an external load changes, the output voltage on line 30 begins to change causing the voltage across the second resistor 20 to change. This in turn changes the voltage on the plus terminal 34 of the error amp 14. The error amp 14 then responds by changing the voltage on line 26. Since the gate of transistor 12 is connected to the output of the error amp 14 by line 26, the voltage drop across the drain to source region of the transistor 12 changes in response to the change in the output voltage of the error amp 14. The error amp 14 will adjust the gate voltage of the transistor 12 so that the output voltage is maintained in the desired range.

The error amp 14 will provide a gate voltage to the PMOS transistor 12 that will keep the voltage between the error amp's two input terminals 34 and 40 as low as possible. Since the voltage on the negative terminal 40 is set by the bandgap voltage reference 16, the voltage on the positive terminal 34 will also be held close to the bandgap voltage.

When the input voltage on line 22 moves higher or the load current being pulled from line 30 decreases, the output voltage on line 30 will move higher until the transistor 12 has adjusted to compensate for the higher input voltage. When the output voltage on line 30 moves higher, the voltage on line 32 between the first resistor 18 and the second resistor 20 will also move higher. Since the voltage on line 32 is the input to the plus terminal 34 of the error amp 14, the output of the error amp 14 will go up because the voltage on the plus terminal 34 is higher than the voltage on the negative terminal 40. This higher output voltage from the error amp 14 increases the gate voltage on transistor 12. In the PMOS transistor 12, a higher gate voltage causes the resistance across the drain to source region to increase, which increases the voltage drop from drain to source. This higher voltage drop across the drain to source region of the transistor 12 causes the output voltage on line 30 to move down to the desired output voltage.

When the input voltage on line 22 moves lower or the load current being pulled from line 30 increases, the output voltage on line 30 will move lower until the transistor 12 has adjusted to compensate for the lower input voltage. When the output voltage on line 30 moves lower, the voltage on line 32 between the first resistor 18 and the second resistor 20 will also move lower. Since the voltage on line 32 is the input to the plus terminal 34 of the error amp 14, the output of the error amp 14 will go down because the voltage on the plus terminal 34 is lower than the voltage on the negative terminal 40. This lower output voltage from the error amp 14 decreases the gate voltage on transistor 12. In the PMOS transistor 12, a lower gate voltage causes the resistance across the drain to source region to decrease, which decreases the voltage drop from drain to source. This lower voltage drop across the drain to source region of the transistor 12 causes the output voltage on line 30 to move up to the desired output voltage.

The resistor multiplier network of resistors 18 and 20 determines the value of the output voltage on line 30. The voltage at line 32 between resistors 18 and 20 is determined by the reference voltage source 16 coupled to the negative terminal 40 of the error amp 14 because the error amp 14 will adjust the circuit so that there is little or no voltage difference between the positive terminal 34 and the negative terminal 40 of the error amp 14. For purposes of analyzing the operation of the circuit, an assumption is made that no current flows through line 36 because no significant level of current flows into the plus terminal 34 of the error amp 14. Therefore, since the voltage across the second resistor 20 is known to be that of the reference voltage source 16, the current flowing through the second resistor 20 is also known. Assuming that no current flows in line 36, then the current flowing through the first resistor 18 is the same as the current flowing through the second resistor 20. Since the current flowing through both resistors 18 and 20 is determined by the equation $I=V_{BG}/R_2$, the output voltage on line 30 is determined by the equation $V_{out}=V_{BG}(R_1+R_2)/R_2$.

This invention has extremely low drop-out voltage. Drop-out occurs when the input voltage comes so close to the output voltage that the circuit can no longer maintain the output voltage at the desired voltage level. In a battery operated device, drop-out usually occurs when the battery is slowly dying. At this point, the output voltage needs to be as close to the input voltage as possible. This invention can get the output voltage within tens of millivolts of the input voltage during drop-out with hundreds of milliamps of load current being pulled from line 30, as opposed to a typical PNP device in which the output voltage is a half volt to a volt lower than the input voltage during drop-out.

By using a PMOS transistor instead of a PNP transistor, less current is needed from the supply on line 22 because there is no significant current through the gate of the PMOS. A PNP requires a base drive current, whereas the PMOS does not have a DC gate current. Even when the circuit goes into very low drop-out, there is still no significant current through the gate of the PMOS, whereas a PNP will have a high base current during very low drop-out because the amplifier will be driving the PNP into saturation. Also, a PMOS transistor has a linear response in drop-out, whereas a PNP does not have a linear response in drop-out. When looking across from drain to source, the PMOS looks just like a resistor during drop-out. This linear response during drop-out is important from a predictability and control standpoint.

This invention provides several advantages. One advantage of this invention is that no DC control current is needed to control the regulation of the PMOS output which is unlike the typical topology of using a PNP output stage. Another advantage of this invention is the linear response of the PMOS pass device in drop-out, unlike a bipolar lateral PNP which does not have a linear response in drop-out. Another advantage of this invention is that there is no dramatic rise in current over various regions of operation, whereas a bipolar device has a significant increase in base drive when it becomes saturated. This low current maintains supply efficiency even in drop-out. Another advantage is that much lower drop-out voltages can be obtained because there is no inherent offset in a PMOS device. Another advantage is that this invention provides very good input regulation and output regulation. Input regulation is how well the output doesn't deviate with the input. Output regulation is how well the output doesn't vary with load variations on the output.

For systems using a battery as the input source, this invention provides increased battery life in several ways. If batteries are used as the input supply, lower drop-out voltage allows operation of the device even when the batteries have sufficiently drained, lowering their voltage. Also, the exceptionally low bias currents required over all regions of operation make the battery last longer due to the lighter drain on its stored energy.

A preferred embodiment has been described in detail hereinabove. It is to be understood that the scope of the invention also comprehends embodiments different from those described, yet within the scope of the claims.

While this invention has been described with reference to an illustrative embodiment, this description is not intended to be construed in a limiting sense. Various modifications and combinations of the illustrative embodiment, as well as other embodiments of the invention, will be apparent to persons skilled in the art upon reference to the description. It is therefore intended that the appended claims encompass any such modifications or embodiments.

What is claimed is:

1. A voltage regulator circuit comprising:

a PMOS transistor connected between a voltage supply line and an output line, the PMOS transistor providing a stable voltage on the output line independent of voltage transients on the voltage supply line and independent of current transients on the output line;

an amplifier connected to the PMOS transistor for controlling the response of the PMOS transistor, a supply voltage input of the amplifier is connected to the voltage supply line; and feedback circuitry connected between the output line and the amplifier, the feedback circuitry providing feedback to the amplifier.

2. The circuit of claim 1, wherein the feedback circuitry includes a first resistor and a second resistor connected in series, the PMOS transistor is coupled to a first end of the first resistor, a second end of the first resistor is coupled to a first end of the second resistor, and the amplifier is coupled to the first end of the second resistor.

3. The circuit of claim 1, further comprising a reference voltage source coupled to the amplifier.

4. The voltage regulator circuit comprising:

a PMOS transistor having a gate, a source, and a drain;

an amplifier connected to the gate of the PMOS transistor;

feedback circuitry coupled to the drain of the PMOS transistor;

a feedback line coupling the feedback circuitry to a first input of the amplifier;

a reference voltage source coupled to a second input of the amplifier;

a supply voltage coupled to the source of the PMOS transistor and to a supply voltage input of the amplifier; and an output line coupled to the drain of the PMOS transistor.

5. The circuit of claim 4, wherein the feedback circuitry includes a first resistor and a second resistor connected in series.

6. The circuit of claim 5, wherein the drain of the transistor is coupled to a first end of the first resistor, a second end of the first resistor is coupled to a first end of the second resistor, and the feedback line is coupled to the first end of the second resistor.

7. The circuit of claim 4, wherein the amplifier is an operational amplifier having a positive input terminal and a negative input terminal.

8. The circuit of claim 7, wherein the first input of the amplifier is the positive input terminal and the second input of the amplifier is the negative input terminal.

9. The circuit of claim 4, wherein the reference voltage source is a silicon bandgap voltage reference.

10. The circuit of claim 4, wherein the output line provides a stable output voltage.

11. A method for regulating a voltage comprising:

coupling a supply voltage to a source of a PMOS transistor and to a supply voltage input of an amplifier;

providing a regulated output voltage from a drain of the PMOS transistor;

connecting a voltage from an output of the amplifier to a gate of the PMOS transistor;

coupling the drain of the PMOS transistor to a feedback network;

coupling the feedback network to a first input of the amplifier; and coupling a reference voltage to a second input of the amplifier.

12. The method of claim 11, wherein the feedback network includes a first resistor and a second resistor connected in series.

13. The method of claim 12, wherein the drain of the transistor is coupled to a first end of the first resistor, a second end of the first resistor is coupled to a first end of the second resistor, and the first input of the amplifier is coupled to the first end of the second resistor.

14. The method of claim 11, wherein the amplifier is an operational amplifier having a positive input terminal and a negative input terminal.

15. The method of claim 14, wherein the first input of the amplifier is the positive input terminal and the second input of the amplifier is the negative input terminal.

16. The method of claim 11, wherein the output line provides a stable output voltage.

* * * * *